US012629571B2

(12) United States Patent
Bennett et al.

(10) Patent No.: US 12,629,571 B2
(45) Date of Patent: May 19, 2026

(54) FAIRWAY WOOD GOLF CLUB

(71) Applicant: Acushnet Company, Fairhaven, MA (US)

(72) Inventors: Thomas Orrin Bennett, Carlsbad, CA (US); Mitchell E. Bac, Temecula, CA (US); Grant M. Martens, San Diego, CA (US)

(73) Assignee: Acushnet Company, Fairhaven, MA (US)

( * ) Notice: Subject to any disclaimer, the term of this patent is extended or adjusted under 35 U.S.C. 154(b) by 399 days.

(21) Appl. No.: 18/327,771

(22) Filed: Jun. 1, 2023

(65) Prior Publication Data

US 2023/0398415 A1 Dec. 14, 2023

Related U.S. Application Data

(63) Continuation-in-part of application No. 17/589,471, filed on Jan. 31, 2022, now Pat. No. 11,679,311.

(51) Int. Cl.
*A63B 53/04* (2015.01)

(52) U.S. Cl.
CPC ..... *A63B 53/0466* (2013.01); *A63B 53/0408* (2020.08); *A63B 53/0433* (2020.08); *A63B 53/0437* (2020.08)

(58) Field of Classification Search
CPC ..... A63B 53/0408; A63B 53/0433
See application file for complete search history.

(56) References Cited

U.S. PATENT DOCUMENTS

| | | | | |
|---|---|---|---|---|
| 8,663,029 | B2 * | 3/2014 | Beach | A63B 53/0466 473/328 |
| 9,682,294 | B2 * | 6/2017 | Burnett | A63B 53/0466 |
| 10,086,240 | B1 * | 10/2018 | Hoffman | A63B 60/00 |
| 11,679,311 | B1 * | 6/2023 | Bennett | A63B 53/0466 473/345 |
| 12,201,879 | B2 * | 1/2025 | Bennett | A63B 53/0433 |
| 2002/0142861 | A1 * | 10/2002 | Helmstetter | A63B 53/04 473/342 |
| 2009/0170632 | A1 * | 7/2009 | Beach | A63B 53/0466 473/335 |

FOREIGN PATENT DOCUMENTS

| | | | | |
|---|---|---|---|---|
| JP | 2001120692 A | * | 5/2001 | A63B 53/0466 |
| JP | 2004049733 A | * | 2/2004 | A63B 53/0466 |
| WO | WO-0132271 A | | 5/2001 | |
| WO | WO-0132271 A1 | * | 5/2001 | A63B 53/0466 |
| WO | WO-0132272 A | | 5/2001 | |
| WO | WO-0132272 A1 | * | 5/2001 | A63B 60/00 |

* cited by examiner

*Primary Examiner* — Alvin A Hunter
(74) *Attorney, Agent, or Firm* — Randy K. Chang

(57) ABSTRACT

A golf club head formed of an alloy of steel that is capable of improving the center of gravity (CG) location while maintaining traditional external dimensions of the golf club head. More specifically, the golf club head in accordance with the present invention achieves a relatively low CG while maintaining traditional external dimensions by reducing the amount of mass contributed by the crown, the striking face, and the hosel, and strategically reallocating this mass within and/or proximate the sole of the golf club head.

19 Claims, 11 Drawing Sheets

FAIRWAY WOOD GOLF CLUB

CROSS-REFERENCE TO RELATED APPLICATIONS

This application is a continuation-in-part (CIP) of co-pending U.S. patent application Ser. No. 17/589,471, filed on Jan. 31, 2022, the disclosure of which is hereby incorporated by reference its entirety.

FIELD OF THE INVENTION

The present invention relates generally to a golf club head, and more specifically, to a steel-bodied fairway wood having a low center of gravity (CG).

BACKGROUND OF THE INVENTION

The rules of golf allow for a golfer to carry fourteen golf clubs. In an ideal world, each of the golf clubs serves a unique purpose. For example, a driver is mostly used to hit the golf ball off of a tee, and preferably a great distance. Fairway woods and hybrid clubs are used to hit the ball far, but not as far as the driver. Fairway woods and hybrids are often used off of the tee when a golfer wants to hit the ball straighter and/or shorter than the driver. Fairway woods and hybrids are also often used without a tee, directly off of the ground. Iron-type golf clubs are used to hit the ball straighter and shorter yet, placing a premium on accuracy.

Each of these various types of golf clubs are specifically designed for maximum effectiveness for their particular purposes. As fairway woods and hybrids are called upon for distance and accuracy, not only off the tee but also off the ground without a tee, they require a unique balance of performance and aesthetics.

Given the broad range of uses for fairway woods and hybrids, it is desirable for the CG to be located low relative to the ground to make it easier to launch a golf shot up in the air, especially for shots struck directly off of the ground without a tee. More often than not, fairway woods and hybrids are constructed primarily of steel alloys. Conventionally, the CG of a fairway wood or hybrid may be lowered by utilizing one of several less than desirable design features.

For example, the peak crown height of the golf club may be reduced to lower the CG. While reduction of the peak crown height of the golf club may allow for a lower CG, the corresponding design tradeoffs are not desirable. The reduction in peak crown height results in a golf club head that is not aesthetically pleasing. Specifically, the golf club head will either be smaller volumetrically than a conventional golf club head, or at the very least appear smaller, and therefore instill less confidence when a golfer prepares to strike a golf shot.

Similarly, the striking face height, (e.g., the ground to top face radius) of the golf club may be reduced. As above, this not only hurts the aesthetics of the golf club, but also makes the golf club more difficult to hit by physically reducing the size of the striking face.

Further, the golf club head may incorporate various materials to manipulate the location of the CG. For example, the crown of the golf club may be formed of any of a number of materials, such as titanium or composites, having a density less than that of steel. While the incorporation of various materials is useful in manipulating the CG of the golf club head, it is costly and brings into a play a litany of potential manufacturing difficulties associated with joining dissimilar materials.

Therefore, what is needed is a fairway wood type golf club head having a steel construction and having a low CG accomplished without modification to the traditional external dimensions of the fairway wood type golf club head.

BRIEF SUMMARY OF THE INVENTION

One aspect of the present invention is a golf club head including a striking face that defines a face center, a crown, a sole opposite said crown, a heel, a toe opposite said heel, and a hosel adjacent said heel and configured to join said golf club head to a shaft, where each of said striking face, said crown, said sole, said heel, said toe, and said hosel comprises of an alloy of steel, where an X-axis is defined as a horizontal axis tangent to said face center of said striking face with a positive direction towards said heel of said golf club head, a Y-axis is a vertical axis orthogonal to said X-axis with a positive direction towards said crown of said golf club head, and a Z-axis being orthogonal to both said X-axis and said Y-axis with a positive direction towards a front of said golf club head, where an origin of said X-axis, said Y-axis, and said Z-axis is centered at a center of gravity (CG) of said golf club head, where said golf club head has a volume of between about 100 cc and about 200 cc, where said crown has a minimum crown thickness of between about 0.3 mm and about 0.6 mm, where said sole has a maximum sole thickness, where said golf club head has a peak crown height of greater than about 35.0 mm, where said golf club head has a ground to top face radius measurement of greater than or equal to about 31.0 mm, where said golf club head has a CG-Yg being a distance from a ground plane to said CG along said y-axis of less than about 16.0 mm, where said golf club head has a ΔYccg of between about 22.0 mm and about 28.0 mm, said ΔYccg defined by the equation below:

ΔYccg=Peak Crown Height (mm)−CG-Yg (mm), said golf club head has a Maximum Sole Thickness to Minimum Crown Thickness Ratio of greater than or equal to about 4.0, said Maximum Sole Thickness to Minimum Crown Thickness Ratio defined by the equation below:

$$\text{Maximum Sole Thickness to Minimum Crown Thickness Ratio} = \frac{\text{Maximum Sole Thickness (mm)}}{\text{Minimum Crown Thickness (mm)}},$$

where a mass of said golf club head below an X-Z plane set at a vertical height from said ground plane equal to 25% of said peak crown height measurement is greater than about 45% of a total mass of said golf club head, where a mass of said golf club head below an X-Z plane set at a vertical height from said ground plane equal to 20% of said peak crown height measurement is greater than about 38% of said total mass of said golf club head, where a mass of said golf club head below an X-Z plane set at a vertical height from said ground plane equal to 15% of said peak crown height measurement is greater than about 27% of said total mass of said golf club head, and where a mass of said golf club head below an X-Z plane set at a vertical height from said ground plane equal to 10% of said peak crown height measurement is greater than about 12% of said total mass of said golf club head.

According to another aspect of the present invention, a golf club head includes: a striking face that defines a face center, a crown, a sole opposite said crown, a heel, a toe opposite said heel, and a hosel adjacent said heel and configured to join said golf club head to a shaft, where each of said striking face, said crown, said sole, said heel, said toe, and said hosel comprises of an alloy of steel, where an X-axis is defined as a horizontal axis tangent to said face center of said striking face with a positive direction towards said heel of said golf club head, a Y-axis is a vertical axis orthogonal to said X-axis with a positive direction towards said crown of said golf club head, and a Z-axis being orthogonal to both said X-axis and said Y-axis with a positive direction towards a front of said golf club head, where an origin of said X-axis, said Y-axis, and said Z-axis is centered at a center of gravity (CG) of said golf club head, where said golf club head has a volume of between about 100 cc and about 200 cc, where said crown has a minimum crown thickness of between about 0.3 mm and about 0.6 mm, where said sole has a maximum sole thickness, and where said golf club head has a Maximum Sole Thickness to Minimum Crown Thickness Ratio of greater than or equal to about 4.0, said Maximum Sole Thickness to Minimum Crown Thickness Ratio defined by the equation below:

$$\text{Maximum Sole Thickness to Minimum Crown Thickness Ratio} = \frac{\text{Maximum Sole Thickness (mm)}}{\text{Minimum Crown Thickness (mm)}}.$$

According to another aspect of the present invention, a golf club head includes: a striking face that defines a face center, a crown, a sole opposite said crown, a heel, a toe opposite said heel, and a hosel adjacent said heel and configured to join said golf club head to a shaft, where each of said striking face, said crown, said sole, said heel, said toe, and said hosel comprises of an alloy of steel, where an X-axis is defined as a horizontal axis tangent to said face center of said striking face with a positive direction towards said heel of said golf club head, a Y-axis is a vertical axis orthogonal to said X-axis with a positive direction towards said crown of said golf club head, and a Z-axis being orthogonal to both said X-axis and said Y-axis with a positive direction towards a front of said golf club head, where an origin of said X-axis, said Y-axis, and said Z-axis is centered at a center of gravity (CG) of said golf club head, where said golf club head has a volume of between about 100 cc and about 200 cc, where said crown has a minimum crown thickness of between about mm and about 0.6 mm, where said sole has a maximum sole thickness, where a mass of said golf club head below an X-Z plane set at a vertical height from said ground plane equal to 25% of said peak crown height measurement is greater than about 45% of a total mass of said golf club head, and where a mass of said golf club head below an X-Z plane set at a vertical height from said ground plane equal to 15% of said peak crown height measurement is greater than about 27% of said total mass of said golf club head. According to another aspect of the present invention the golf club head has a Max Face Thickness to Sole Return Thickness Ratio of between about 1.70 to about 2.18, said Max Face Thickness to Sole Return Thickness Ration defined as:

$$\text{Max Face Thickness to Sole Return Thickness Ratio} = \frac{\text{Max Face Thickness } (T_{f1})}{\text{Sole Return Thickness } (T_R)}.$$

According to another aspect of the present invention, the striking face has a sole return.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention.

The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Before beginning the discussion on the current inventive golf club head 100 and its performance criteria, it is worthwhile to note here that the discussion below will be based on a coordinate system 101 and axes of measurement that are critical to the proper valuation of the performance variables detailed hereinafter. Hence, it is important to recognize that although the specific names given for the measurements below are important to the understanding of the current invention, the naming nomenclature should not be viewed in a vacuum. Rather, the importance of the numbers presented below must be taken in context with how the coordinate system relates to the golf club head itself. In order to provide sufficient information to avoid any ambiguity, each of the figures provided below referencing golf club head 100 will all be accompanied by a reference coordinate system.

Figure 1:
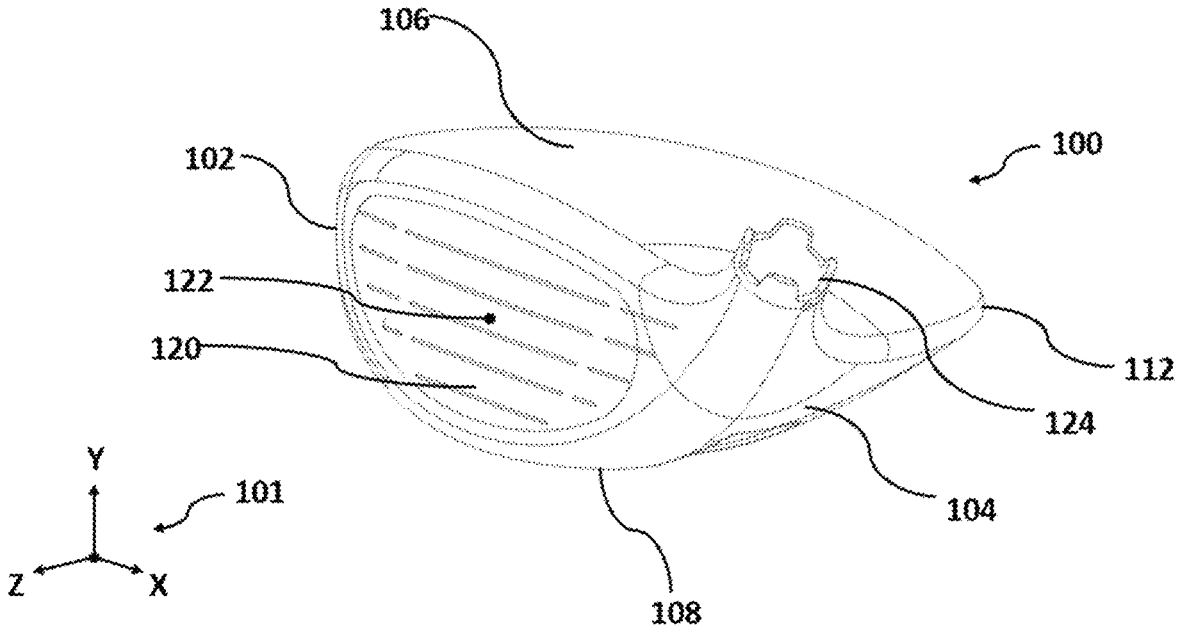
FIG. 1 of the accompanying drawings shows a perspective view of a golf club head in accordance with an exemplary embodiment of the present invention.

Pursuant to the above, and to establish the reference coordinate system for the subsequent discussion, FIG. 1 of the accompanying drawings shows the coordinate system 101 that will be used to define the various measurement and performance figures for the current invention. The X-axis used by the current discussion refers to the axis that is horizontal to the striking face from a heel-to-toe direction. The Y-axis used by the current discussion refers to the vertical axis through the club in a crown-to-sole direction. The Z-axis used by the current discussion refers to the horizontal axis that is horizontal in a front-to-back direction. Alternatively speaking, it can be the X-axis is defined as a horizontal axis tangent to a geometric center of the striking face with the positive direction towards a heel of the golf club head, a Y-axis is a vertical axis orthogonal to the X-axis with a positive direction towards a top of the golf club head, and a Z-axis being orthogonal to both the X-axis and the Y-axis with a positive direction towards a front of the golf club head. The X-Y-Z coordinate system 101 described above shall be the same for all subsequent discussions.

FIG. 1 of the accompanying drawings shows a perspective view of a golf club head 100 in accordance with an embodiment of the present invention. In this perspective view shown in FIG. 1, the golf club head 100 may not look very different than other golf club heads, but the subsequent figures and discussion thereof will show that the specific dimensions and the material properties of this golf club head 100 allow it to achieve unique performance properties consistent with the present invention. What FIG. 1 does show is a golf club head 100 having a striking face 120, a crown 106, a sole 108 opposite the crown 106, a heel 104, a toe 102 opposite the heel 104, a hosel 124 proximate the heel for coupling the golf club head 100 to a shaft (not shown), and a skirt 112 joining the crown 106 and the sole 108 and extending from the heel 104 proximate the striking face 120 to the toe 102 proximate the striking face 120. The striking face 120 has a face center 122. The face center 122, as shown here and referred to by the current invention, relates to the geometric center of the striking face 120 of said golf club head 100 measured by the USGA provided face center template as it would be commonly known to a person of ordinary skill in the golf club art.

In this embodiment of the present invention, the golf club head 100, and specifically the striking face 120, the crown 106, the sole 108, the skirt 112, the toe 102, the heel 104, and the hosel 124 may generally be formed of an alloy of steel having a density of between about 7.75 g/cc and about 8.05 g/cc. Preferably, the golf club head 100 is formed via a casting process as known in the art. It is also within the scope and content of the present invention for at least a portion of the golf club head 100 to be formed via other known processes including stamping, forging, and rolling.

It is within the scope of the present invention for the striking face 120, the crown 106, the sole 108, the skirt 112, the toe 102, the heel 104, and the hosel 124 to be formed entirely of an alloy of steel having a density of between about 7.75 g/cc and about 8.05 g/cc.

It is within the scope and content of the present invention for the striking face 120 to be formed unitarily with the other portions of the golf club head 100, or alternatively to be formed as a separate component that is subsequently joined to the other portions of the golf club head 100. When the striking face 120 is formed as a separate component, it may be formed of a high-strength steel and may be joined to the golf club head 100 through any suitable manner including welding, brazing, adhesives, and mechanical fasteners. Exemplary high-strength steel materials for forming the striking face 120 include Custom 465 Stainless Steel, Custom 475 Stainless Steel, 300 Stainless Steel, and 301 Stainless Steel, though the present invention is not limited in this regard.

Golf club head 100 may generally have a volume between about 100 cc and about 200 cc, more preferably between about 120 cc and about 190 cc, and most preferably between about 140 cc and about 185 cc.

Golf club head 100 may generally have a total mass between about 175 g and about 275 g, more preferably between about 190 g and about 250 g, and most preferably between about 200 g and about 225 g.

Figure 2:
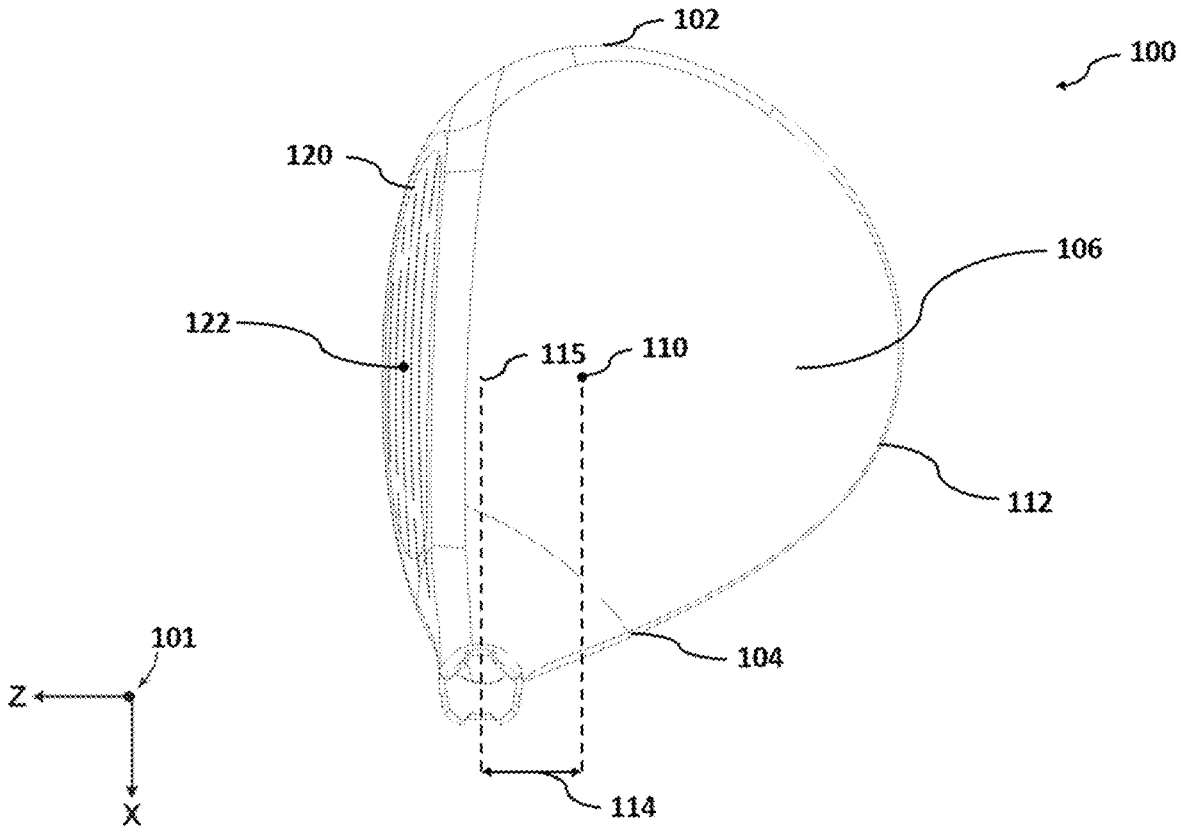
FIG. 2 of the accompanying drawings shows a crown-side view of a golf club head in accordance with an embodiment of the present invention, FIG. 3 of the accompanying drawings shows a face-side view of a golf club head in accordance with an embodiment of the present invention, FIG. 4 of the accompanying drawings shows a toe-side cross-sectional view taken along vertical plane extending along the Z-axis and passing through the face center of a golf club head in accordance with an embodiment of the present invention, FIG. 5A of the accompanying drawings shows a perspective view of a sole of a golf club head in accordance with an embodiment of the present invention, FIG. 5*b* of the accompanying drawings shows a perspective view of a sole of a golf club head in accordance with an alternative embodiment of the present invention, FIG. 6 of the accompanying drawings shows a heel side exploded perspective view of a golf club head in accordance with an alternative embodiment of the present invention, FIG. 7 of the accompanying drawings shows a toe side exploded perspective view of a golf club head in accordance with an alternative embodiment of the present invention, FIG. 8 of the accompanying drawings shows a cross-sectional view of a golf club head in accordance with an alternative embodiment of the present invention.

FIG. 2 is a crown view of golf club head 100. In order to illustrate more specific features of the golf club head 100, FIG. 2 of the accompanying drawings is provided to give additional insight into some of the specific characteristics of the golf club head 100 that will be important to quantify its improved performance. FIG. 2 of the accompanying drawings shows the CG 110 location along the X-Z plane on the coordinate system 101. Although the details of the CG 110 location will be discussed in more detail with respect to the inertial properties of the golf club head 100, generally speaking, the current inventive golf club head 100 has a CG 110 location that is strategically located within the golf club head 100 to yield the most advantageous results.

More specifically, in the current exemplary embodiment of the present invention, the CG 110 is located a distance CG-C 114 rearward from a shaft axis 115 extending along the X-Y plane generally between about 9 mm and about 16 mm, more preferably between about 10 mm and about 15 mm, and most preferably between about 11 mm and about 14 mm, all measured rearward from shaft axis 115 along the Z-axis shown by the coordinate system 101.

It should be noted that the strategic location of the CG 110 rearward along the Z-axis is critical to the proper functionality of the current inventive golf club head 100. If the CG 110 location is too far forward, the golf club head 100 can result in reduced inertial values and can also lead to producing a sub-optimal amount of backspin when contacting a golf ball to yield less than desirable results. However, in the alternative, if the CG 110 location is too far rearward, the golf club head 100 can produce too much spin to yield desirable results. Hence, it can be seen that the criticality of the CG 110 location rearward of the shaft axis 115 along the Z-axis requires a fine balance within a very specific range of values, and deviation from that range can severely hinder the performance of the golf club head 100.

Figure 3:
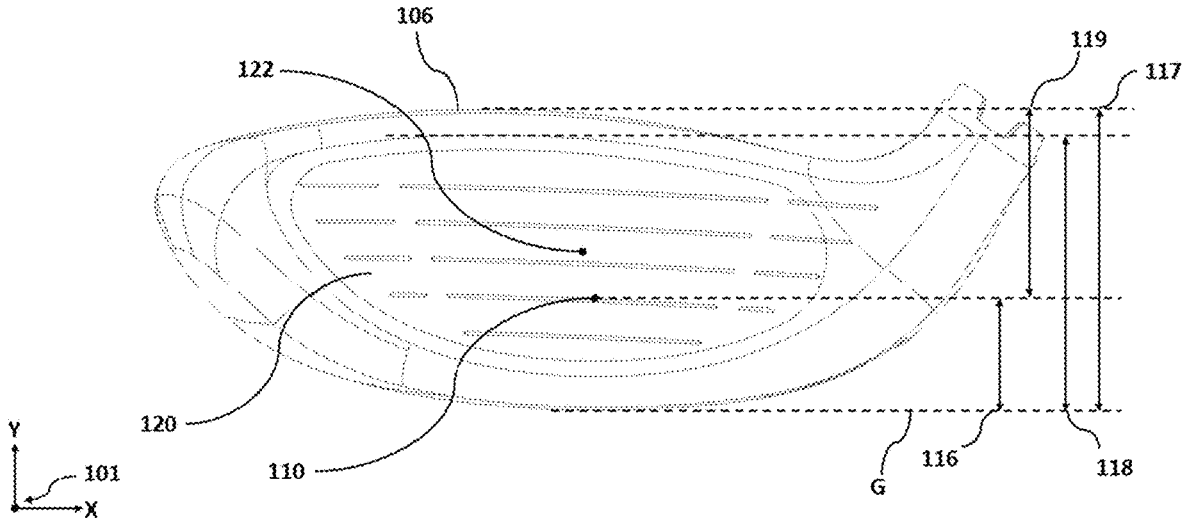

FIG. 3 of the accompanying drawings is a face side view of golf club head 100. FIG. 3 shows several additional dimensional measurements that are important to the proper functionality of the current invention. Specifically, FIG. 3, in addition to illustrating the basic components of the golf club head 100 as previously shown, now introduces another measurement of the CG 110 location from the ground plane G along an X-Y plane shown by coordinate system 101. More specifically, FIG. 3 shows a CG 110 measurement that is the distance measured vertically along the Y-axis from the ground plane G to the CG 110, called CG-Yg 116 for the purpose of this discussion. The CG-Yg 116 of the golf club head 100 may generally be less than about 16.0 mm, more preferably between about 11.0 mm and about 15.0 mm, and most preferably between about 12.0 mm and about 14.5 mm.

In addition to illustrating the very important CG-Yg 116 measurement of the golf club head 100, FIG. 3 of the accompanying drawings also shows a peak crown height 117 measurement being a vertical distance along the Y-axis from the ground plane G to the peak of the crown 106 when the golf club head 100 is held in a normal address position. The peak crown height 117 measurement may generally be greater than about 35.0 mm, preferably between about 36.0 mm and about 43.0 mm, and most preferably between about 37.0 mm and about 41.0 mm.

FIG. 3 of the accompanying drawings also shows a ground to top face radius measurement 118 that is a vertical distance along the Y-axis from the ground plane G to the point where the striking face 120 transitions into the crown 106. More specifically, the ground to top face radius measurement 118 is a vertical distance along the Y-axis from the ground plane G to the point where the golf club head 100 deviates from the roll radius of the striking face 120. It is within the scope and content of the present invention for the ground to top face radius measurement 118 to be taken directly above face center 122 along the Y-axis or at the highest such point on the striking face 120. Preferably, the ground to top face radius measurement 118 is taken directly above face center 122. The ground to top face radius measurement 118 may generally be greater than or equal to about 31.0 mm, more preferably between about 31.0 mm and about 37.0 mm, and most preferably between about 33.0 mm and about 35.0 mm.

FIG. 3 of the accompanying drawings also shows a ΔYccg 119 measurement that is a vertical distance along the Y-axis from the CG 110 to the peak of the crown 106. In other words, the ΔYccg measurement 119 is the difference between the peak crown height 117 measurement and the CG-Yg 116 measurement. The ΔYccg 119 measurement is discussed in greater detail below.

Now that the CG 110 location of the golf club head 100 has been defined, other important features associated with the present invention relating to the Moment of Inertia (MOI) of the golf club head 100 can be further elaborated upon. The MOI of a golf club head generally depicts the ability of the golf club head to resist twisting when it impacts an object at a location that is not aligned with the CG location previously discussed. More specifically, the MOI of a golf club head relates to the ability of the golf club head to resist twisting relative to the CG location.

As is well known in the art, the MOI of the golf club head 100 may generally be broken down to a plurality of unique components, relating to the ability of the golf club head 100 to resist rotation relative to the CG 110 location along different axes, with the origin of the three axes being coincident with the CG 110 location of the golf club head 100. The three axes of rotation for which the MOI is generally referred coincide with the coordinate system 101 shown throughout the drawings, where MOI-X is measured about the X-axis passing through the CG 110 location, MOI-Y is measured about the Y-axis passing through the CG 110 location, and MOI-Z is measured about the Z-axis passing through the CG 110 location.

The current inventive golf club head 100 may generally have an MOI-X that is greater than about 80 kg-mm$^2$, more preferably between about 90 kg-mm$^2$ and about 140 kg-mm$^2$, and most preferably between about 100 kg-mm$^2$ and about 130 kg-mm$^2$, all without departing from the scope and content of the present invention.

The current inventive golf club head 100 may generally have an MOI-Y that is greater than about 220 kg-mm$^2$, more preferably greater than about 230 kg-mm$^2$, and most preferably greater than about 240 kg-mm$^2$, all without departing from the scope and content of the present invention. Put another way, the current inventive golf club head 100 may generally have a high value for MOI-Y, while also maintaining a relatively low CG 110 location.

The current inventive golf club head 100 may generally have an MOI-Z that is greater than about 160 kg-mm$^2$, more preferably between about 160 kg-mm$^2$ and about 220 kg-mm$^2$, and most preferably between about 170 kg-mm$^2$ and about 210 kg-mm$^2$ all without departing from the scope and content of the present invention.

While the MOI values discussed above are not necessarily new in the world of golf club head 100 designs, the ability to maintain those number while positioning the CG 110 location as described above, particularly the relative values of CG-Yg 116 and CG-C 114, is what makes the present invention. The present invention drives the CG lower than ever before in a steel golf club head, while maintaining the traditional fairway wood dimensions such as volume, peak crown height, and ground to top face radius height.

Figure 4:
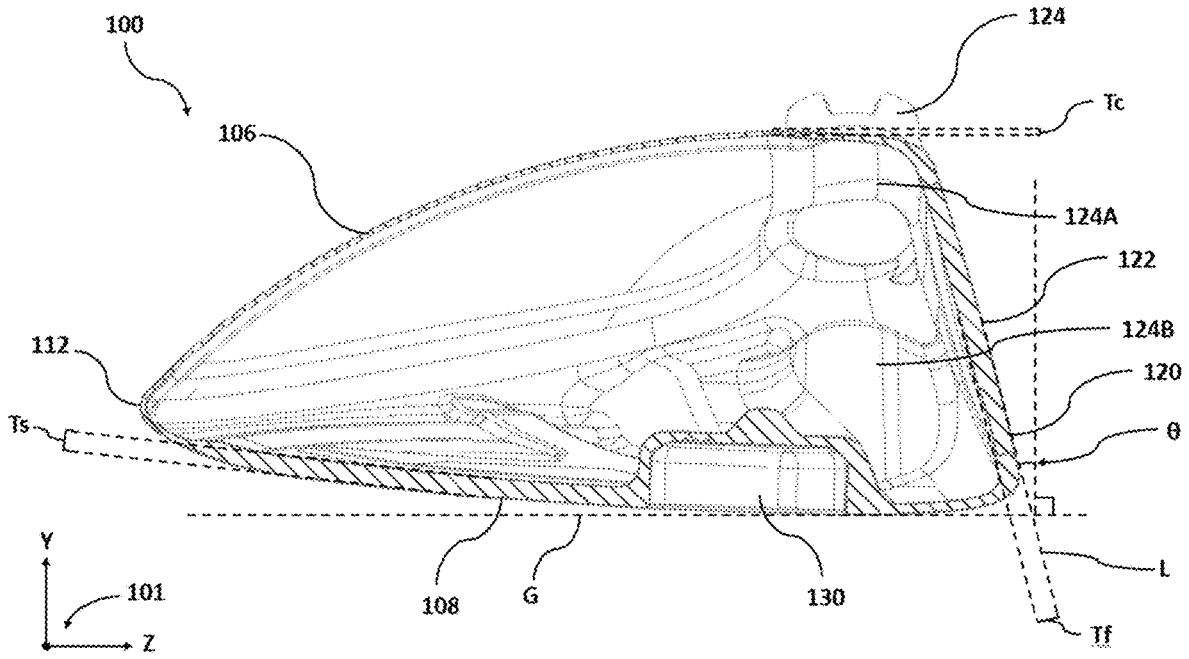

FIG. 4 is a toe-side cross-sectional view taken along vertical plane passing through the face center 122 and extending along the Z-axis. As described below, FIG. 4 illustrates several additional critical features of the present invention.

Referring now to FIG. 4, several of the dimensions of the golf club head 100 that illustrate additional inventive features of the present invention are more clearly shown. According to an exemplary embodiment of the present invention, a minimum crown thickness Tc of the crown 106 is thinner than a that of a traditional cast steel crown, which is conventionally greater than 0.6 mm. According to the current exemplary embodiment, the minimum crown thickness Tc of the crown 106 is preferably between about 0.3 mm and about 0.6 mm, more preferably between about 0.35 mm and about 0.5 mm, and most preferably about 0.4 mm.

Moreover, a portion of the crown may have a substantially constant thickness within +/−10% of the minimum crown thickness Tc of the crown 106. For the purposes of this discussion, the surface area of the crown 106 is defined by that portion of the golf club head 100, excluding the hosel 124, that is visible from directly above the golf club head 100 when the golf club head 100 is in a normal address position. According to an embodiment of the present invention, at least about 40% of a total surface area of the crown 106 may have a substantially constant thickness within +/−10% of the minimum crown thickness Tc, preferably at least about 60% of a total surface area of the crown 106 may have a substantially constant thickness within +/−10% of the minimum crown thickness Tc, and most preferably at least about 75% of a total surface area of the crown 106 may have a substantially constant thickness within +/−10% of the minimum crown thickness Tc.

By reducing the thickness of the crown 106 as described above, the total mass of the crown 106 may be reduced. The mass savings associated with the reduction in thickness of the crown 106 may be reallocated as discretionary mass throughout the golf club head 100, for example as discretionary mass within and/or proximate the sole 108. The golf club head 100 of the present invention having a crown 106 as described above may exhibit a CG-Yg 116 measurement that is at least 0.3 mm lower than a conventional golf club head having a minimum crown thickness of greater than 0.6 mm. While a reduction in CG-Yg 116 measurement of 0.3 mm may seem minor at first glance, the present invention relies on a number of inventive features to drive CG-Yg 116 measurement lower than any other known golf club head formed of steel and having traditional dimensions as described above.

FIG. 4 illustrates another feature that further facilitates the lowering of the CG-Yg 116 measurement of the golf club head 100. It is well known for a striking face to have different thicknesses at different points across the striking face, this is known as variable face thickness (VFT). In an exemplary embodiment of the present invention, a maximum face thickness Tf occurs proximate the face center 122 and is preferably less than about 2.0 mm, more preferably less than about 1.95 mm, and most preferably about 1.9 mm. Conventionally, the maximum face thickness Tf of a steel striking face is greater than about 2.0 mm. The golf club head 100 of the present invention having a striking face 120 as described above may exhibit a CG-Yg 116 measurement that is at least 0.1 mm lower than a conventional golf club head having a maximum face thickness Tf of at least 2.0 mm. The maximum face thickness Tf is a distance between the exterior and interior surfaces of the striking face measured perpendicular to the loft plane L, where the loft plane L is a plane tangent to the face center 122 of the striking face 120. While a reduction in CG-Yg 116 of 0.1 mm may seem minor at first glance, the present invention relies on a number of inventive features to drive the CG-Yg 116 lower than any other known golf club head formed of steel and having traditional dimensions as described above.

FIG. 4 also illustrates a loft angle θ being an angle between the loft plane L and an X-Y plane. Preferably the loft angle θ is between about 12 degrees and about 25 degrees.

FIG. 4 also illustrates a unique hosel 124 construction for use with an adjustable shaft sleeve (not shown) as known in the art. The hosel 124 is adapted to adjustably couple the golf club head 100 to a shaft (not shown). Hosel 124 includes an upper hosel portion 124A proximate said crown 106 and a lower hosel portion 124B proximate said sole 108. The upper hosel portion 124A is adapted to receive an adjustable shaft sleeve (not shown) to provide for adjustability for the orientation (lie, loft, and face angle) of the golf club head 100. The lower hosel portion 124B is adapted to receive a fastener (not shown) for coupling the shaft sleeve (not shown) to the golf club head 100, as is well known in the art. In contrast to conventional constructions, a portion of the hosel 124 between the upper hosel portion 124A and the lower hosel portion 124B is open to an interior of the golf club head 100.

As compared to such a conventional hosel as described above, the total mass of the hosel 124, which includes a discrete upper hosel portion 124A and a discrete lower hosel portion 124B, and especially that portion of the mass of the hosel 124 above the CG 110 location may be reduced. The mass savings associated with the hosel 124 as compared to the conventional hosel design may be reallocated as discretionary mass throughout the golf club head 100, for example as discretionary mass within and/or proximate the sole 108. The golf club head 100 of the present invention having hosel 124 as described above may exhibit a CG-Yg 116 measurement that is at least 0.35 mm lower than a conventional golf club head having a conventional hosel adapted to receive a conventional adjustable shaft sleeve. As above, a reduction in a CG-Yg 116 measurement of 0.35 mm may seem minor at first glance; however, the present invention relies on a number of inventive features to drive the CG-Yg 116 measurement lower than any other known golf club head formed of steel and having traditional dimensions as described above.

FIG. 4 also illustrates an optional weight pocket 130 positioned proximate the sole 108 of the golf club head 100. The weight pocket 130 is adapted to receive a weight member (not shown) therein. The structure of the weight member is not critical to the present invention and it should be understood that the weight member may take the form of known structures as well as modifications of known structures. The weight member may be formed of any number of materials having a density either less than, equal to, or greater than that of the remainder of the golf club head 100. Preferably the weight member may be formed of an alloy of steel having a density that is substantially equal to that of the remainder of the golf club head 100. Alternatively, the weight member may include a material having a density greater than that of the steel portions of the golf club head 100, for example, at least one of tungsten, molybdenum, tantalum, hafnium, and niobium. It is also within the scope of the present invention for the weight member to include a material having a density less than that of the steel portions of the golf club head 100, for example, at least one of titanium, aluminum, plastic, and composites. The mass saved by reducing the minimum thickness of the crown 106, reducing the maximum thickness of the striking face 120, and modifying the construction of the hosel 124 to be open to an interior of the golf club head 100 may be allocated as discretionary mass within and/or proximate the sole 108. For example, discretionary mass may be allocated in the sole 108, within the weight member, or within any portion of the golf club head 100 below the CG 110 to minimize the values of CG-Yg 116 measurement while also maintaining the traditional dimensions and other highlighted inertial values of the golf club head 100.

As shown in FIG. 4, a substantial portion of the sole 108 has a substantially constant thickness. Moreover, that portion of the sole 108 aft of the weight pocket 130 having the substantially constant thickness is substantially equal to a maximum sole thickness Ts. For the purposes of identifying the maximum sole thickness Ts, it is noted that the portions of the sole 108 defining and proximate the weight pocket 130 and the portions of the sole within about 10 mm of the skirt 112 are not considered. The maximum sole thickness Ts is preferably greater than or equal to about 1.6 mm, more preferably greater than or equal to about 1.8 mm, and most preferably greater than or equal to about 1.9 mm.

According to an embodiment of the present invention, at least 30% of the sole 108 has a thickness within +/−10% of the maximum sole thickness Ts, more preferably at least 40% of the sole 108 has a thickness within +/−10% of the maximum sole thickness Ts, and most preferably at least 50% of the sole 108 has a thickness within +/−10% of the maximum sole thickness Ts.

It is worth noting at this time that the maximum sole thickness Ts does not capture the entire impact of the mass concentrated within and/or proximate the sole 108, as by its very definition it does not account for the weight pocket 130, the weight member, or any additional elements required to fix the weight member within the weight pocket 130.

Figure 5A:
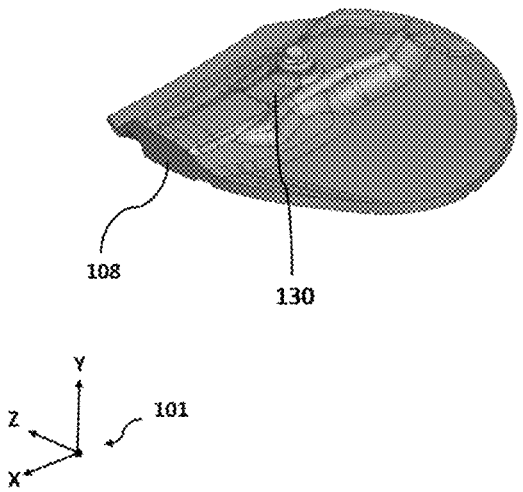
Figure 5B:
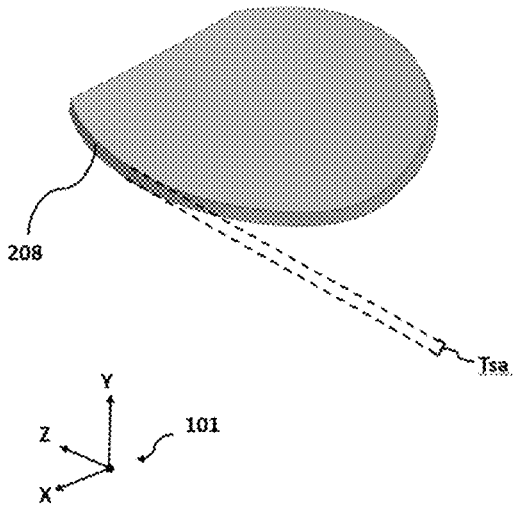

To better illustrate these features, FIGS. 5A and 5B are provided. FIG. 5A shows the sole 108 separated from remainder of the golf club head 100 and FIG. 5B shows a sole 208 in accordance with an alternative embodiment of the present invention.

Referring first to FIG. 5A, the sole 108 is shown apart from the remainder of the golf club head 100. From this perspective, it is far easier to see how the weight pocket 130, weight member (not shown), and surrounding structures have the potential to concentrate mass within and/or proximate the sole 108 for the purposes of driving the CG 110 closer to the ground. It can also be seen how describing a portion of the sole 108 as having a substantially constant thickness does not paint the full picture of the contribution of the sole 108 toward driving the CG 110 closer to the ground. Specifically, describing the sole 108 in this way does not capture the impact of the weight member (not shown) or the portions of the sole 108 that define and/or support the weight pocket 130.

It is worth noting at this time that establishing that portion of the golf club head 100 which defines sole 108 is not as simple as identifying the bottom of the golf club head 100. For example, the sole 108 may be defined as the entirety of the golf club head 100 that is visible from directly below the golf club head 100 when the golf club head 100 is in a normal address position. Alternatively, the sole 108 may be defined as the portion of the golf club head 100 bounded by the lower extent of the skirt 112 and the lower extent of the striking face 120.

To quantify the impact of the sole 108 in accordance with an exemplary embodiment of the present invention in a meaningful and simple way, the sole 108 may be defined as a portion of the golf club head 100 being generally centrally located on the bottom of the golf club head 100 and having an external surface area of between about 25 $cm^2$ and about 35 $cm^2$. The sole 108, including the weight pocket 130 and the weight member (not shown) therein may have a total mass of between about 50 g and about 80 g.

FIG. 5B shows a sole 208 that has the same perimeter shape, surface area, and total mass as the sole 108, including the weight pocket 130 housing a weight member (not shown) having the same density as the golf club head 100.

Sole 208 is configured to be interchangeable with sole 108 in that sole 208 has the same perimeter shape, the same external surface area of between about 25 $cm^2$ and about $cm^2$, and the same mass of between about 50 g and about 80 g. However, in contrast to the sole 108, sole 208 does not include a weight pocket, therefore the sole 208 has an increased thickness as compared to sole 108. The increased thickness of sole 208 assists in quantifying the overall impact of the sole 208 on the CG 110 location.

According to embodiments of the present invention, the sole 208 may have an average effective sole thickness Tsa of between about 2.4 mm and about 3.2 mm, and preferably between about 2.5 mm and about 3.1 mm, and most preferably between about 2.6 mm and about 3.0 mm. The average effective sole thickness Tsa is determined by dividing the total mass of the sole 208 by the external surface area of the sole 208. Therefore, while the average effective sole thickness Tsa is a constant thickness in the sole 208, the average effective sole thickness Tsa takes into account the mass contributed by the weight pocket 130 and any weight member (not shown) housed therein. Therefore it can be said that the sole 108 has the same average effective sole thickness Tsa as the sole 208, as both sole 108 and sole 208 have the same total mass and external surface area. Moreover, sole 208 is configured to have the same impact on the CG 110 location and MOI of the golf club head 100 as sole 108.

The combined effect on the CG-Yg 116 measurement associated with the reduction of the minimum thickness of the crown 106, reduction of the maximum thickness of the striking face 120, modification of the construction of the hosel 124 to be open to an interior of the golf club head 100, and allocation of the mass saved above within and/or proximate the sole 108, 208 as described above, results in a CG-Yg 116 measurement that is between about 1.5 mm and about 2.0 mm lower than any known steel golf club head having traditional dimensions as set forth above.

It should be noted here that the low CG-Yg 116 measurement mentioned above cannot accurately depict and describe the current invention alone; as golf club heads having reduced volume or overly shallow (shorter peak crown height and/or shorter face height) dimensions may inherently have low CG-Yg measurements. Hence, it is important to recognize here that the present invention is predicated on the interrelationship between the different numbers achieved by the CG-C, MOI, volume, and height measurements as they relate the CG-Yg 116 measurements articulated above.

Another way to capture the impact of the mass savings articulated above is looking at the percentage of the mass of the golf club head 100 concentrated within the lower extent of the golf club head 100. Referring back to FIG. 3, it is useful to consider the allocation of mass within the golf club head 100 as percentage of the peak crown height 117 measurement.

The mass of the golf club head 100 below an X-Z plane set at a vertical height from the ground plane G equal to 25% of the peak crown height 117 measurement is preferably greater than about 45% of the total mass of the golf club head 100, more preferably greater than about 48% of the total mass of the golf club head 100, and most preferably greater than about 50% of the total mass of the golf club head 100.

The mass of the golf club head 100 below an X-Z plane set at a vertical height from the ground plane G equal to 20% of the peak crown height 117 measurement is preferably greater than about 38% of the total mass of the golf club head 100, more preferably greater than about 41% of the total mass of the golf club head 100, and most preferably greater than about 43% of the total mass of the golf club head 100.

The mass of the golf club head 100 below an X-Z plane set at a vertical height from the ground plane G equal to 15% of the peak crown height 117 measurement is preferably greater than about 27% of the total mass of the golf club head 100, more preferably greater than about 30% of the total mass of the golf club head 100, and most preferably greater than about 32% of the total mass of the golf club head 100.

The mass of the golf club head 100 below an X-Z plane set at a vertical height from the ground plane G equal to 10% of the peak crown height 117 measurement is preferably greater than about 12% of the total mass of the golf club head 100, more preferably greater than about 15% of the total mass of the golf club head 100, and most preferably greater than about 17% of the total mass of the golf club head 100.

By concentrating a majority of the mass of the golf club head 100 toward the sole 108 of the golf club head 100, the CG-Yg 116 may be reduced as described above.

At this time it is worth discussing a relationship that is unique to the present invention between the mass of the sole 108, 208 and the external surface area of sole 108, 208 to better capture how the golf club head 100 achieves the inertial and dimensional features articulated above. The Sole Mass to Sole Surface Area Ratio helps to quantify the current golf club head 100 as illustrated by the equation below. In one exemplary embodiment of the present invention, the Sole Mass to Sole Surface Area Ratio of sole 108 and sole 208 is greater than or equal to about 2.0 g/cm$^2$, more preferably greater than or equal to about 2.1 g/cm$^2$, and most preferably greater than or equal to about 2.2 g/cm$^2$.

$$\text{Sole Mass to Sole Surface Area Ratio} = \frac{\text{Total Mass of Sole (g)}}{\text{External Surface Area of Sole (cm}^2\text{)}}$$

Another relationship that is unique to the present invention is that between the peak crown height 117 measurement and the CG-Yg 116 measurement. A ratio called a Weighted Peak Crown Height to CG-Yg Ratio helps to quantify the current golf club head 100 as illustrated by the equation below. The Weighted Peak Crown Height to CG-Yg Ratio is a product of the cosine of the loft angle θ and a ratio between the peak crown height 117 measurement and the CG-Yg 116 measurement. In one exemplary embodiment the Weighted Peak Crown Height to CG-Yg Ratio of golf club head 100 is greater than or equal to about 2.4, preferably about greater than or equal to about 2.5, and most preferably greater than or equal to about 2.6.

$$\text{Weighted Peak Crown Height to } CG\text{-}Yg \text{ Ratio} = \cos(\theta) * \frac{\text{Peak Crown Height (mm)}}{CG\text{-}Yg\text{ (mm)}}$$

As described above, the Weighted Peak Crown Height to CG-Yg Ratio is critically important to the present invention as it combines the performance benefits of a low CG 110 with a traditional shape of golf club head 100. While it is possible to drive CG 110 down using known techniques, these known techniques require the use of exotic materials and/or alteration of the traditional shape of the golf club head, for example, by reducing the peak crown height or the ground to top face radius of the golf club head.

Another relationship that is unique to the present invention also involves the difference between the peak crown height 117 measurement and the CG-Yg 116. A vertical distance between the peak crown height 117 measurement and the CG-Yg 116 called the ΔYccg 119 helps to quantify the current golf club head 100 as illustrated by the equation below. In one exemplary embodiment the ΔYccg 119 of golf club head 100 is between about 22.0 mm and about 28.0 mm, preferably between about 23.0 mm and about 26.0 mm, and most preferably between about 24.0 mm and about 25.0 mm.

$$\Delta Yccg = \text{Peak Crown Height (mm)} - \text{CG-}Yg\text{ (mm)}$$

$$\Delta Yccg = \text{Peak Crown Height (mm)} - \text{CG-}Yg\text{ (mm)}$$

As described above, the ΔYccg is critically important to the present invention as it combines the performance benefits of a low CG 110 with a traditional shape of golf club head 100. While it is possible to drive CG 110 down using known techniques, these known techniques require the use of exotic materials and/or alteration of the traditional shape of the golf club head, for example, by reducing the peak crown height or the ground to top face radius of the golf club head.

Another relationship that is unique to the present invention is that between the minimum crown thickness Tc and the maximum sole thickness Ts. The minimum crown thickness Tc, as defined in the current invention, refers to the portion of the crown 106 having the smallest wall thickness which may include any cutouts that may be present in the crown 106 portion of the golf club head. The maximum sole thickness Ts on the other hand, as defined in the current invention, refers to the portion of the sole 108 having the greatest wall thickness, which may include any sole graphic, but excludes any ribs and/or any portions of the sole associated with external weighting features that may create a visual illusion of a thickened sole 108. The Maximum Sole Thickness to Minimum Crown Thickness Ratio helps to quantify the current golf club head 100 as illustrated by the equation below. In one exemplary embodiment of the present invention, the Maximum Sole Thickness to Minimum Crown Thickness Ratio is greater than or equal to about 4.0, preferably greater than or equal to about 4.5, and most preferably greater than or equal to about 4.75.

$$\text{Maximum Sole Thickness to Minimum Crown Thickness Ratio} = \frac{\text{Maximum Sole Thickness (mm)}}{\text{Minimum Crown Thickness (mm)}}$$

As described above, the Maximum Sole Thickness to Minimum Crown Thickness Ratio is critically important to the present invention as it combines the performance benefits of a low CG 110 with an all steel construction of golf club head 100. While it is possible to drive CG 110 similarly down using known techniques, these known techniques require the use of exotic materials, for example, by forming the crown of a different material such as titanium or composites.

Another relationship that is unique to the present invention is that between the average effective sole thickness Tsa and the minimum crown thickness Tc. The Average Effective Sole Thickness to Minimum Crown Thickness Ratio helps to quantify the current golf club head 100 as illustrated by the equation below. In one exemplary embodiment, the Average Effective Sole Thickness to Minimum Crown Thickness Ratio is between about 3.5 and about 9.0, preferably between about 4.5 and about 8.5, and most preferably between about 5.0 and about 8.0.

Average Effective Sole Thickness Ratio to Minimum Crown $$\text{Thickness Ratio} = \frac{\text{Average Effective Sole Thickness (mm)}}{\text{Minimum Crown Thickness (mm)}}$$

As described above, the Average Effective Sole Thickness to Minimum Crown Thickness Ratio is critically important to the present invention as it combines the performance benefits of a low CG 110 with an all steel construction of golf club head 100. While it is possible to drive CG 110 similarly close to the ground using known techniques, these known techniques require the use of exotic materials, for example, by forming the crown of a different material such as titanium or composites.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

According to another embodiment of the present invention, the crown 106 may be formed of a lightweight material having a density less than that of steel. For example, the crown 106 may be formed of a composite material or an alloy of titanium. The golf club head 100 of the present invention having crown 106 formed of a composite material as described above may exhibit a CG-Yg 116 measurement that is at least 0.20 mm lower than a conventional golf club head having an all steel construction. As above, a reduction in a CG-Yg 116 measurement of 0.20 mm may seem minor at first glance; however, the present invention relies on a number of inventive features to drive the CG-Yg 116 measurement lower than any other known golf club head having traditional dimensions as described above.

Figure 6:
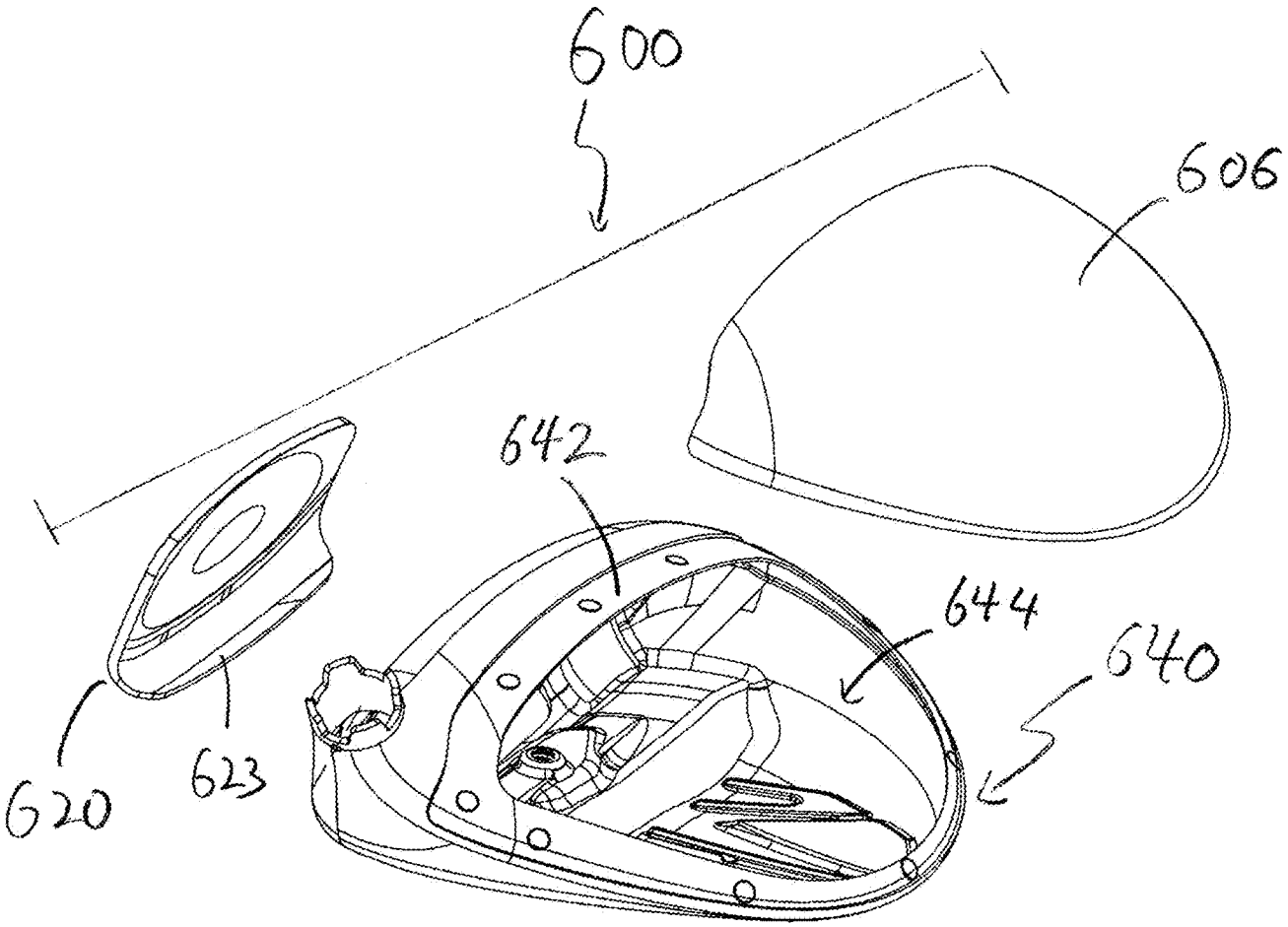

FIG. 6 of the accompanying drawings shows an exploded view of a golf club head 600 in accordance with an alternative embodiment of the present invention wherein the striking face 620, instead of being a face insert as shown in previous embodiments, is in the shape of an L-Cup having a sole return 623. Having an L-Cup shaped striking face can further improve the performance of the golf club head 600 not just by improving the center of gravity location of the golf club head 600 in the ranges articulated above but can also provide more structural integrity to the leading edge of the golf club head 600 itself. Increasing structural integrity of the golf club head 600 at the leading edge can further enhance the performance of the golf club head 600 by lowering spin for shots that are hit on the striking face 620, which is a common phenomenon in fairway woods such as the present invention.

The striking face 620 can be attached to the body portion 640 of the golf club head 600 via a frontal opening 621 (shown in FIG. 7) via traditional attachment techniques such as welding, however, in alternative embodiments of the present invention, other attachment techniques such as brazing, gluing, or any other types of attachment techniques may also be used without departing from the scope and content of the present invention.

The golf club head 600 shown here in FIG. 6 also differs from previous embodiments of the present invention by having a crown opening 644 with a recessed ledge 642 located around a perimeter of the crown opening 642 that is adapted to accept a crown 606. In this current embodiment of the present invention, the crown 606 may be made out of a lightweight composite material that reduce weight from that portion of the golf club head 600. The utilization of a lightweight composite material to form the crown 606 generates more discretionary mass, which can be more strategically placed to achieve the CG, MOI, and mass distribution values discussed above.

Figure 7:
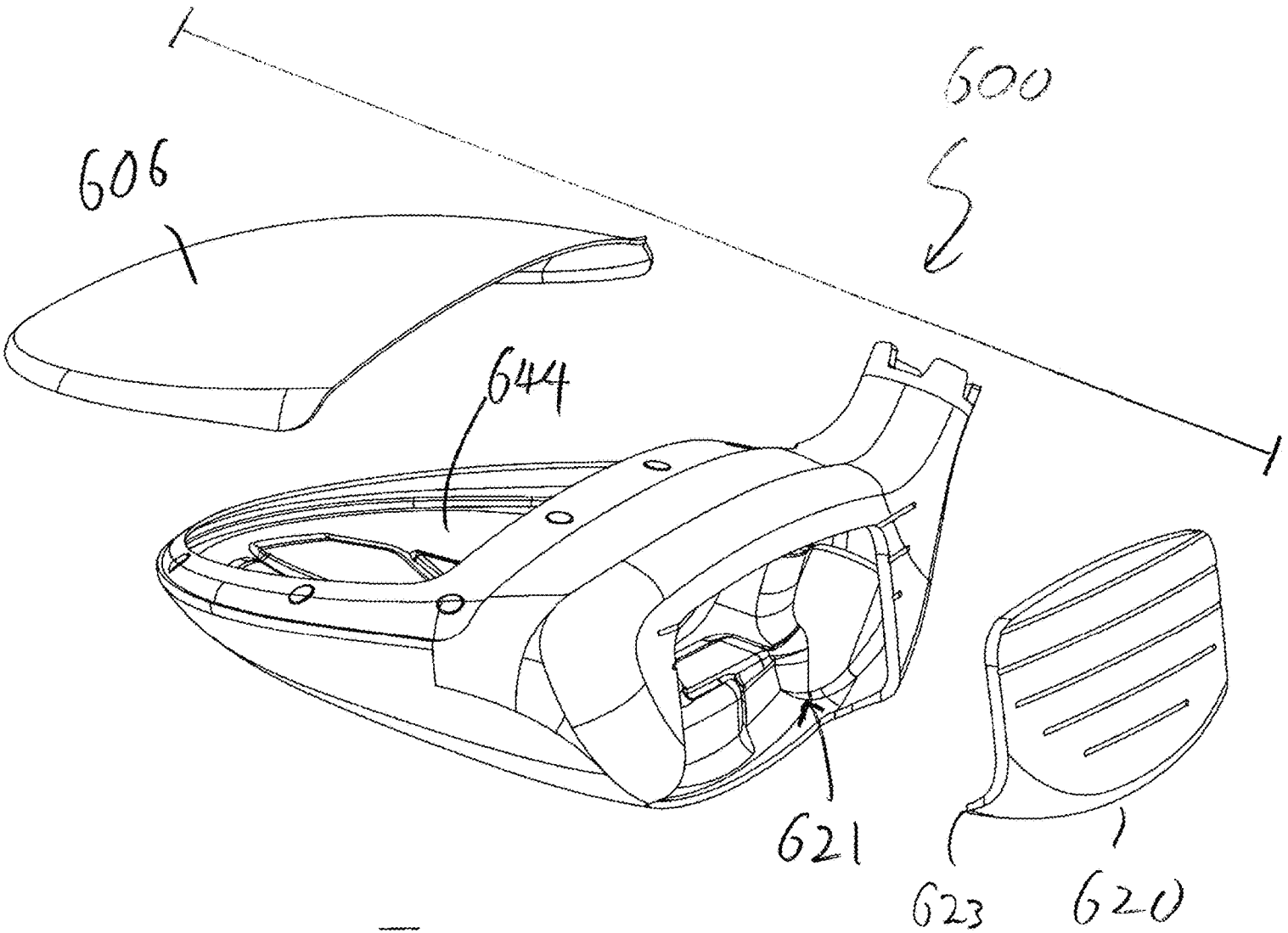

FIG. 7 of the accompanying drawings shows another exploded perspective view of golf club head 600 from a different angle, allowing the frontal opening 621 to be shown more clearly. As it can be seen from this view, the frontal opening 621 includes the leading edge of the golf club head 600 and at least partially forms a frontal portion of the sole of the golf club head 600. Consequently, due to the shape of the frontal opening 621 the striking face 620, having the L-Cup geometry will form the leading edge portion of the golf club head 600, together with the frontal portion of the sole of the golf club head 600. However, it should be noted that other types of complimentary shapes between the frontal opening 621 and the striking face 620 different from the L-Cup geometry shown here may also be used without departing from the scope and content of the present invention, so long as the shapes of striking face 620 compliment the geometry of the frontal opening 621.

Figure 8:
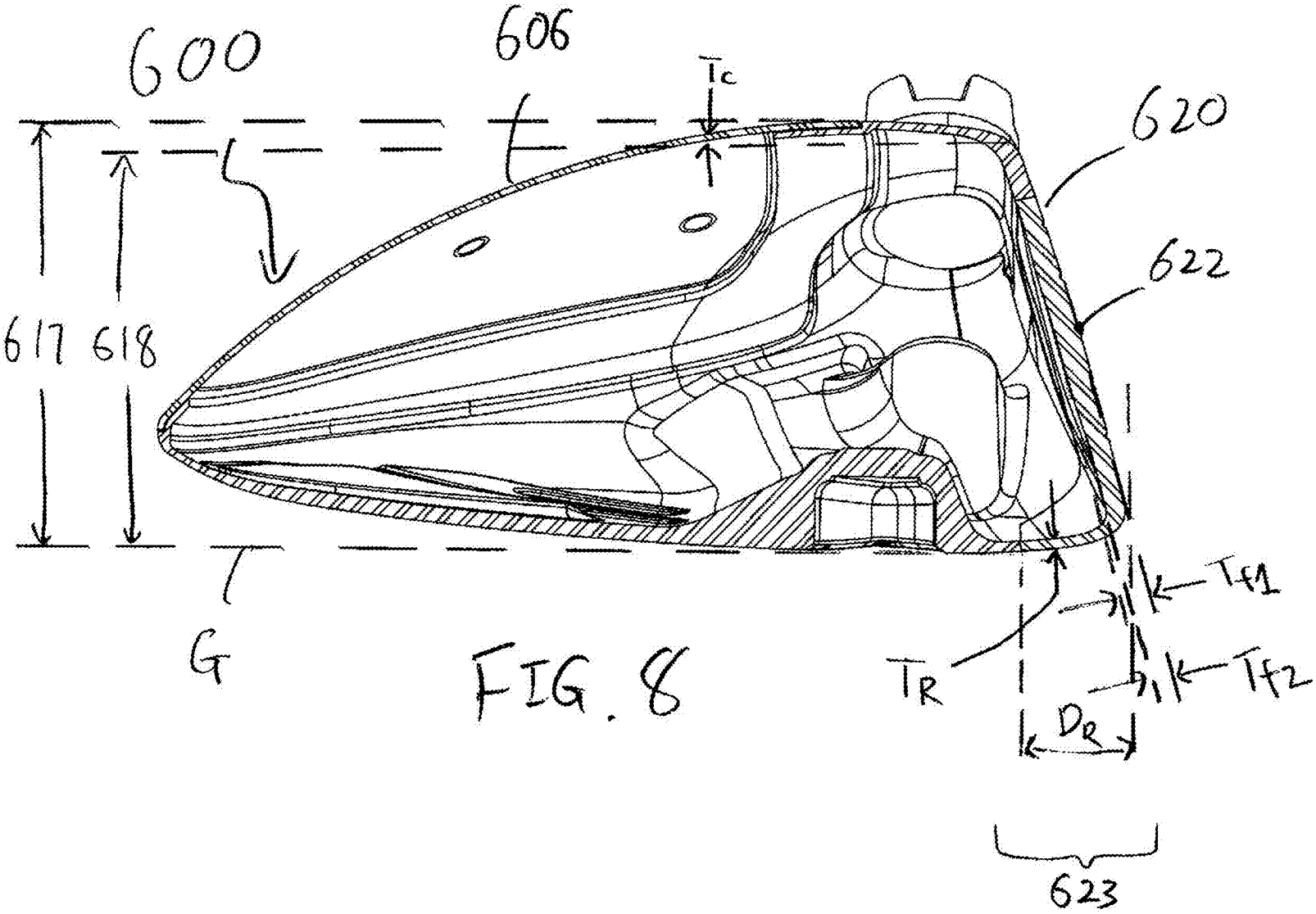

FIG. 8 of the accompanying drawings shows a cross-sectional view of golf club head 600 taken along a vertical plane passing through the face center 622 and extending along the Z-axis. This cross-sectional view of the golf club head 600 allows the various thicknesses and dimensions of the golf club head 600 to be shown in more detail. First and foremost, it can be seen that the striking face 620 may have a variable thickness, with the thickest portion of the striking face having a first thickness Tf1 being located near the geometric face center 622, while the perimeter portion of the striking face may have a reduced thickness Tf2. Unlike in previous embodiments where the striking face has a unitary thickness, the present invention, by utilizing a variable face thickness profile, is capable of reducing the thickness of the first thickness Tf1 to be between about 1.8 mm to about 2.1 mm, more preferably between about 1.9 mm to about 2.1 mm, and most preferably between about 2.0 mm to about 2.1 mm. The second thickness Tf2, which always less than the first thickness Tf1, may generally have a thickness of between about 1.70 mm to about 1.75 mm, more preferably between about 1.70 mm to about 1.73 mm, and most preferably between about 1.70 mm to about 1.72 mm.

In addition to illustrating the striking face 620, the cross sectional view of golf club head 600 shown in FIG. 8 also shows the new important feature of a L-Cup striking face 620 along with its various dimensions. First and foremost, FIG. 8 shows that the striking face 620 has a sole return 623 distance $D_R$ that forms the leading edge and a frontal portion of the sole of the golf club head 600. The sole return 923 distance $D_R$ is measured from the forwardmost portion of the leading edge towards the rear of the L-Cup striking face 620; and in this embodiment of the present invention, may generally be between about 9.0 mm to about 11.0 mm, more preferably between 9.5 mm to about 10.5 mm, most preferably about 10.0 mm. In addition to the length of the sole return 623 distance $D_R$, FIG. 8 of the accompanying drawings also illustrates the thickness of the sole return 623 thickness $T_R$. $T_R$ as shown in this embodiment of the present invention may generally be between about 0.8 mm to about 1.0 mm, more preferably between about 0.85 mm to about 0.95 mm, and most preferably about 0.9 mm.

Now that the dimensions of the striking face 640 have been established, it is worth noting that the dimensions of this L-Cup shaped striking face 620 is critical to the proper performance of the present inventive golf club head 600, especially the relationship between the substantially vertical planar portion of the L-Cup striking face 620 and the lower return portion of the L-Cup striking face 620. Hence, in accordance with the present invention, the golf club head 600 may have a Max Face Thickness to Sole Thickness Ratio of between about 1.70 to about 2.18, more preferably between about 1.78 to about 2.03, and most preferably between about 1.88 to about 1.91, wherein the Max Face Thickness to Sole Return Thickness Ratio is defined as:

$$\text{Max Face Thickness to Sole Return Thickness Ratio} = \frac{\text{Max Face Thickness } (T_{f1})}{\text{Sole Return Thickness } (T_R)}$$

Another important ratio that can be extrapolated from the dimension of the golf club head 600 shown in FIG. 8 is the Max Face Thickness to Sole Return Distance Ratio defined as:

$$\text{Max Face Thickness to Sole Return Distance Ratio} = \frac{\text{Max Face Thickness } (T_{f1})}{\text{Sole Return Distance } (T_R)}$$

The Max Face Thickness to Sole Return Distance Ratio in accordance with the present invention may generally be between 0.15 to about 0.19, more preferably between about to about 0.18, and most preferably about 0.17.

Finally, it should be noted that the sole return 623 portion of the striking face 622 contains a unique relationship between the sole return 623 distance and the sole return 623 thickness, creating a Sole Return Distance to Thickness Ratio defined as:

$$\text{Sole Return Distance to Thickness Ratio} = \frac{\text{Sole Return Distance } (D_R)}{\text{Sole Return Thickness } (T_R)}$$

The Sole Return Distance to Thickness Ratio in accordance with the present invention may generally be between about 9 to about 13.75, more preferably between about 10 to about 12.35, and most preferably about 11.

FIG. 8 of the accompanying drawings, in addition to illustrating the dimension and feature of the striking face 620, also show some ancillary features of the golf club head 600. Near the top of the golf club head 600, we can see that the crown 606 that is made out of a high strength composite material here may have a thickness Tc of less than about mm, more preferably less than about 0.55 mm, and most preferably less than about 0.54 mm. The golf club head 600 may have a ground to top face radius measurement 618 of between about 33.0 mm to about 36 mm, more preferably between about 34.0 mm to about 35 mm, and most preferably about 34.5 mm. Finally, the golf club head 600 may have a peak crown height 617 of between about 36 mm to about 40 mm, more preferably between 37 mm to about 39 mm, and most preferably about 38 mm.

Figure 9:
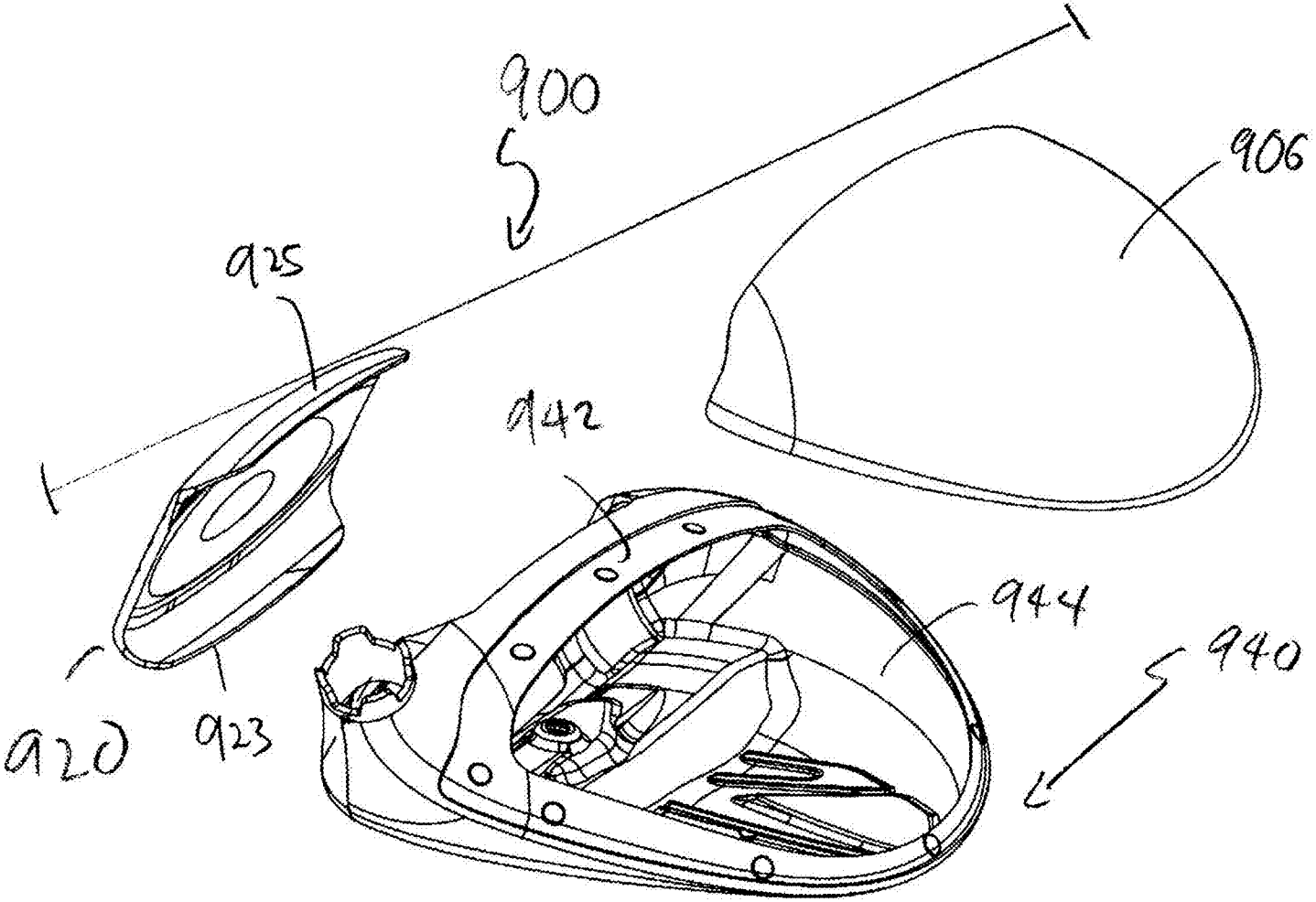
FIG. 9 of the accompanying drawings shows a heel side exploded perspective view of a golf club head in accordance with an alternative embodiment of the present invention, FIG. 10 of the accompanying drawings shows a toe side exploded perspective view of a golf club head in accordance with an alternative embodiment of the present invention, and FIG. 11 of the accompanying drawings shows a cross-sectional view of a golf club head in accordance with an alternative embodiment of the present invention.
Figure 10:
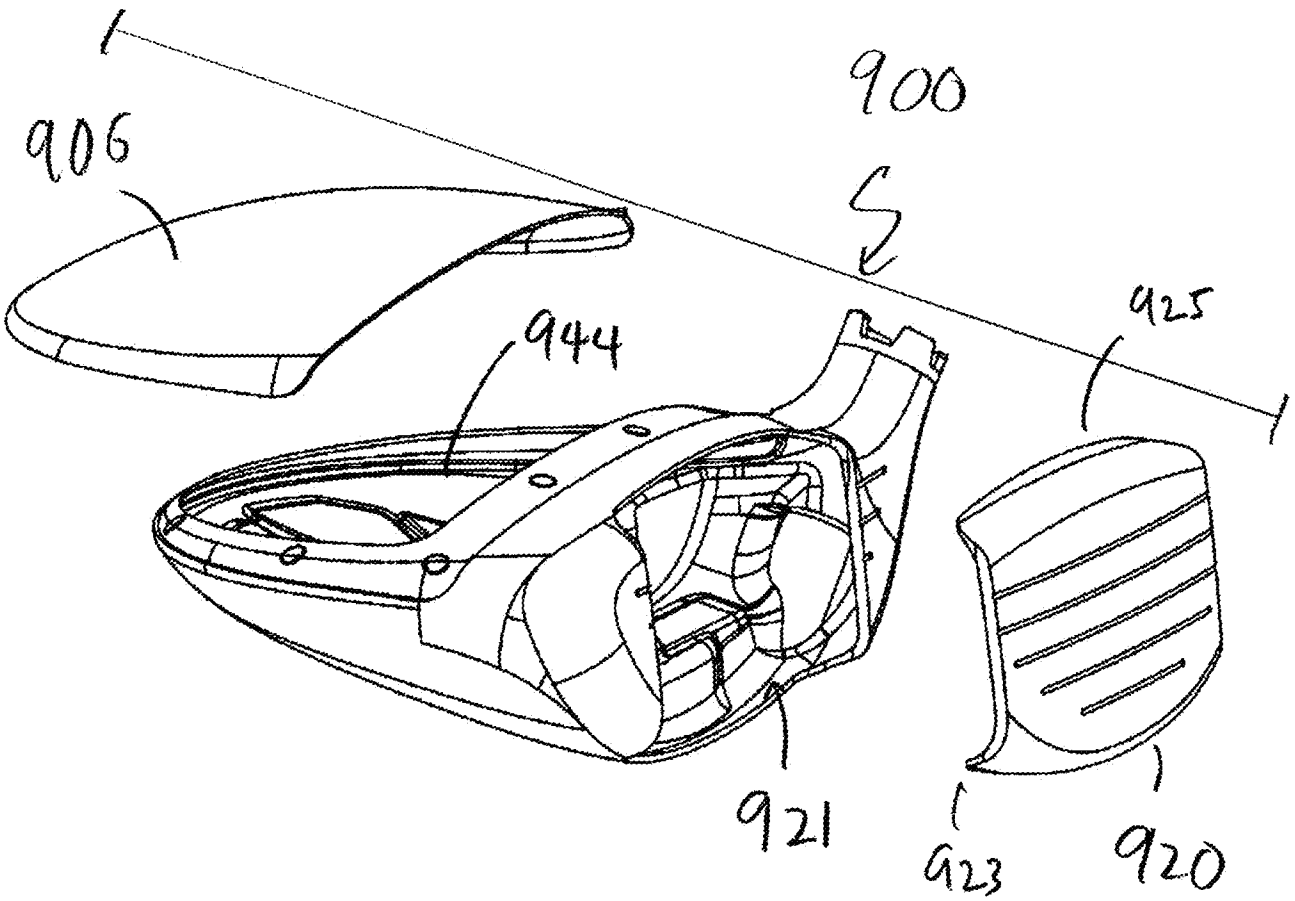
Figure 11:
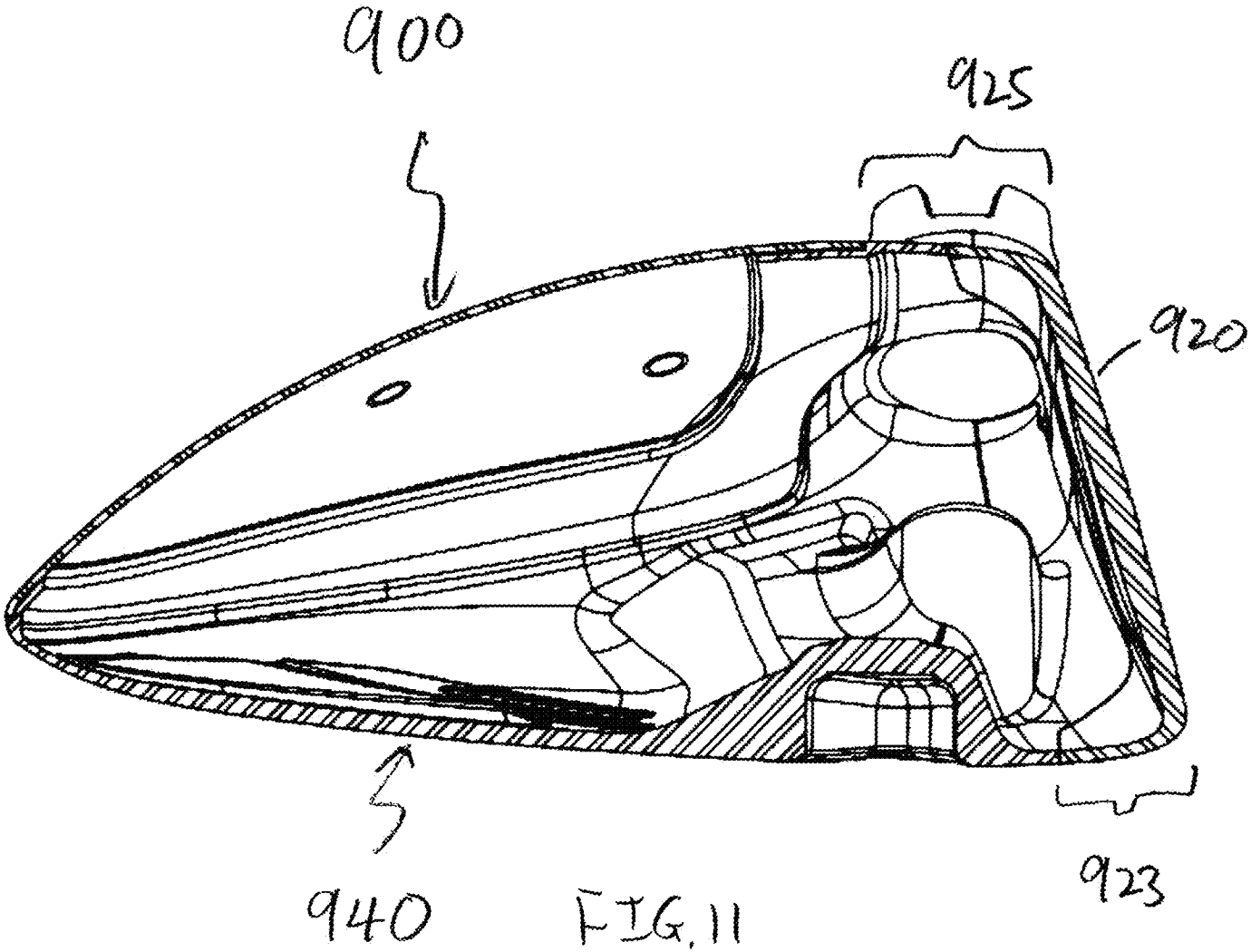

FIGS. 9, 10, and 11 of the accompanying drawings shows two exploded perspective view and one cross sectional view of a golf club head 900 in accordance with an alternative embodiment of the present invention wherein the striking face 920 has a crown return 925 in addition to the sole return 923, taking on the shape of a C-Cup. Talking in generalities about FIGS. 9, 10, and 11, it can be seen that golf club head 900 has a body portion 940 with a frontal opening 921 that is shaped to be without the leading edge as well as the crown transition in order to accommodate a similarly shaped striking face 920 with a crown return 925 and a sole return 923. The body portion 940, similar to previous embodiments shown, may also have a crown opening 944 with a recessed ledge 942 adapted to receive a lightweight crown 906 that is generally made out of a lightweight composite material. The attachment means of the striking face 920 and the crown 906 to the frontal opening 921 and crown opening 944 respectively, are similar to the attachment methods of striking face 620 and crown 606 as previously discussed.

The cross-sectional view of the golf club head 900 shown in FIG. 11, similar to the cross-sectional view of golf club head 600 shown in FIG. 8, allows the internals of the golf club head 900 to be shown more clearly. This cross-sectional view of the golf club head 900 shown here shows the striking face 920 being in the shape of a C-Cup, having the crown return and the sole return as previously mentioned, illustrates how this alternative embodiment is capable of achieving the CG and MOI properties previously mentioned, as well as the interface between the various components.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims. and scope of the invention as set forth in the following claims.

What is claimed is:

1. A golf club head comprising:

a striking face that defines a face center, a crown, as sole opposite said crown, a heel, a toe opposite said heel, and a hosel adjacent said heel and configured to join said golf club head to a shaft, wherein an X-axis is defined as a horizontal axis tangent to said face center of said striking face with a positive direction towards said heel of said golf club head, a Y-axis is a vertical axis orthogonal to said X-axis with a positive direction towards said crown of said golf club head, and a Z-axis being orthogonal to both said X-axis and said Y-axis with a positive direction towards a front of said golf club head, wherein an origin of said X-axis, said Y-axis, and said Z-axis is centered at a center of gravity (CG) of said golf club head, wherein said crown has a minimum crown thickness of between about 0.3 mm and about 0.6 mm, wherein said golf club head below an X-Z plane set at a vertical height from a ground plane equal to 25% of a peak crown height measurement is greater than about 45% of a total mass of said golf club head, and wherein said striking face has a Max Face Thickness to Sole Return Thickness Ratio of between about 1.70 to about 2.18, said Max Face Thickness to Sole Return Thickness Ration defined as:

$$\text{Max Face Thickness to Sole Return Thickness Ratio} = \frac{\text{Max Face Thickness } (T_{f1})}{\text{Sole Return Thickness } (T_R)}.$$

2. The golf club head of claim 1, wherein said Max Face Thickness to Sole Return Thickness Ratio is between about 1.78 to about 2.03.

3. The golf club head of claim 2, wherein said Max Face Thickness to Sole Return Thickness Ratio is between about 1.88 to about 1.91.

4. The golf club head of claim 1, wherein said striking face further comprises a sole return, wherein said sole return has a sole return distance of between about 9.0 mm to about 11.0 mm.

5. The golf club head of claim 4, wherein said sole return distance is between about 9.5 mm to about 10.5 mm.

6. The golf club head of claim 5, wherein said sole return distance is about 10.0 mm.

7. The golf club head of claim 6, wherein said striking face further comprises a sole return thickness of between about 0.8 mm to about 1.0 mm.

8. The golf club head of claim 7, wherein said sole return thickness is between about 0.85 to about 0.95 mm.

9. The golf club head of claim 8, wherein said sole return thickness is about 0.9 mm.

10. The golf club head of claim 1, wherein said golf club head has a peak crown height of greater than about 35 mm.

11. The golf club head of claim 10, wherein said golf club head has a ground to top face radius measurement of greater than or equal to about 31.0 mm.

12. A golf club head comprising:

a striking face, having a face center, a crown, as sole opposite said crown, a heel, a toe opposite said heel, and a hosel adjacent said heel and configured to join said golf club head to a shaft, wherein said striking face has a sole return, wherein an X-axis is defined as a horizontal axis tangent to said face center of said striking face with a positive direction towards said heel of said golf club head, a Y-axis is a vertical axis orthogonal to said X-axis with a positive direction towards said crown of said golf club head, and a Z-axis being orthogonal to both said X-axis and said Y-axis with a positive direction towards a front of said golf club head, wherein an origin of said X-axis, said Y-axis, and said Z-axis is centered at a center of gravity (CG) of said golf club head, wherein said crown has a minimum crown thickness of between about 0.3 mm and about 0.6 mm, wherein said sole return has a sole return distance of between about 9.0 mm to about 11.0 mm, and wherein a mass of said golf club head below an X-Z plane set at a vertical height from a ground plane equal to 25% of a peak crown height measurement is greater than about 45% of a total mass of said golf club head.

13. The golf club head of claim 12, wherein said sole return distance is between about 9.5 mm to about 10.5 mm.

14. The golf club head of claim 13, wherein said sole return distance is about 10.0 mm.

15. The golf club head of claim 12, wherein said striking face of said golf club head has a Max Face Thickness to Sole Return Distance Ratio of between about 0.15 to about 0.19, said Max Face Thickness to Sole Return Distance Ratio defined as:

$$\text{Max Face Thickness to Sole Return Distance Ratio} = \frac{\text{Max Face Thickness } (T_{f1})}{\text{Sole Return Distance } (D_R)}.$$

16. The golf club head of claim 15, wherein said Max Face Thickness to Sole Return Distance Ratio is between about 0.16 to about 0.18.

17. The golf club head of claim 16, wherein said Max Face Thickness to Sole Return Distance Ratio is about 0.17.

18. The golf club head of claim 17, wherein said golf club head has a Maximum Sole Thickness to Minimum Crown Thickness Ratio of greater than or equal to about 4.0, said Maximum Sole Thickness to Minimum Crown Thickness Ratio defined as:

$$\text{Maximum Sole Thickness to Minimum Crown Thickness Ratio} = \frac{\text{Maximum Sole Thickness (mm)}}{\text{Minimum Crown Thickness (mm)}}.$$

19. A golf club head comprising:

a striking face that defines a face center, a crown, as sole opposite said crown, a heel, a toe opposite said heel, and a hosel adjacent said heel and configured to join said golf club head to a shaft, wherein said striking face has a sole return, wherein an X-axis is defined as a horizontal axis tangent to said face center of said striking face with a positive direction towards said heel of said golf club head, a Y-axis is a vertical axis orthogonal to said X-axis with a positive direction towards said crown of said golf club head, and a Z-axis being orthogonal to both said X-axis and said Y-axis with a positive direction towards a front of said golf club head, wherein an origin of said X-axis, said Y-axis, and said Z-axis is centered at a center of gravity (CG) of said golf club head, wherein said crown has a minimum crown thickness of between about 0.3 mm and about 0.6 mm, wherein said sole return has a sole return distance of between about 9.0 mm to about 11.0 mm.

wherein a mass of said golf club head below an X-Z plane set at a vertical height from a ground plane equal to 25% of a peak crown height measurement is greater than about 45% of a total mass of said golf club head, and wherein said golf club head has a Maximum Sole Thickness to Minimum Crown Thickness Ratio of greater than or equal to about 4.0, said Maximum Sole Thickness to Minimum Crown Thickness Ratio defined as:

$$\text{Maximum Sole Thickness to Minimum Crown Thickness Ratio} = \frac{\text{Maximum Sole Thickness (mm)}}{\text{Minimum Crown Thickness (mm)}}.$$

* * * * *